US007924546B2

(12) United States Patent
Graham

(10) Patent No.: US 7,924,546 B2
(45) Date of Patent: Apr. 12, 2011

(54) BURNER IGNITION CONTROLLER AND IMPROVED COIL BOBBIN

(75) Inventor: John P. Graham, Elyria, OH (US)

(73) Assignee: R.W. Beckett Corporation, North Ridgeville, OH (US)

( * ) Notice: Subject to any disclaimer, the term of this patent is extended or adjusted under 35 U.S.C. 154(b) by 272 days.

(21) Appl. No.: 11/870,245

(22) Filed: Oct. 10, 2007

(65) Prior Publication Data

US 2008/0090191 A1 Apr. 17, 2008

Related U.S. Application Data

(60) Provisional application No. 60/851,624, filed on Oct. 13, 2006.

(51) Int. Cl.
*F23Q 7/06* (2006.01)

(52) U.S. Cl. ..... 361/236; 431/238

(58) Field of Classification Search ..... 361/263, 361/253; 123/634

See application file for complete search history.

(56) References Cited

U.S. PATENT DOCUMENTS 4,035,751 A * 7/1977 Walthew ..... 336/60
4,683,518 A * 7/1987 Gwozdz ..... 361/263
2002/0159214 A1* 10/2002 Perlick et al. ..... 361/160

* cited by examiner

*Primary Examiner* — Jared J Fureman
*Assistant Examiner* — Angela Brooks
(74) *Attorney, Agent, or Firm* — Eschweiler & Associates, LLC

(57) ABSTRACT

A system is presented for an improved igniter and an igniter bobbin for a high voltage burner igniter that reduces parts count and simplifies assembly of the igniter used in fuel based burners for boilers, forced air furnaces and water heaters. In one aspect of the invention, the igniter bobbin of the present invention comprises two high voltage insulators and a coil bobbin of a high voltage transformer molded or otherwise integrated together into a single monolithic structure. In another aspect, the igniter bobbin may be molded from an insulative material to form the single monolithic structure that insulates the high voltage electrodes which are inserted within the high voltage insulators portion of the structure, and to insulate the primary and secondary coils that are wound onto the coil bobbin portion of the structure.

26 Claims, 9 Drawing Sheets

SECTION A-A

BURNER IGNITION CONTROLLER AND IMPROVED COIL BOBBIN

REFERENCE TO RELATED APPLICATION

This application claims priority to and the benefit of U.S. Provisional Application Ser. No. 60/851,624 which was filed Oct. 13, 2006, entitled "Burner Ignition Controller and Improved Coil Bobbin", the entirety of which is hereby incorporated by reference as if fully set forth herein.

FIELD OF INVENTION

The present invention relates generally to burner igniters and more particularly to an improved coil bobbin for a high voltage burner igniter that reduces parts count and simplifies assembly of the igniter used in fuel based burners for boilers, forced air furnaces and water heaters.

BACKGROUND OF THE INVENTION

Fuel-based heating systems typically employ a high voltage spark ignition system or igniter to initiate combustion of a fuel-air mix within burners for boilers, forced air furnaces and water heaters. Such burners typically burn fuel oil, diesel oil, or natural gas in both residential and commercial heating applications. For example, a residential oil burner for heating a home may include a burner motor that drives a fan or blower and oil pump to force the fuel-air mix into a burner flame tube or combustion head. The burner also includes a high voltage igniter to create a spark in the flame tube that ignites the fuel-air mixture, a flame sensor to detect when a stable flame is present, and an electronic control module. The electronic control module often controls and monitors all the burner functions, timings, and maintains regulated operation of the system, for example, by further monitoring a user set thermostat.

Despite a convenient modular construction, there is still a considerable number of parts required within such burner systems that require substantial material and labor costs to fabricate and assemble. One such component that requires detailed fabrication costs is the high voltage igniter. The igniter may essentially comprise a high voltage switching power supply that has many electronic components mounted on a printed circuit board (PCB) and also includes, for example, a custom built high voltage (HV) switching transformer. The custom high voltage transformer may be potted, for example, in epoxy, urethane, silicone rubber or another such insulative potting material. The HV transformer and all the components may then be mounted on the PCB and hand or wave-soldered to connect all the components and supply leads to the PCB. High voltage insulators may then be hand soldered, bolted, or otherwise attached to the PCB, for connection to external high voltage terminals of the flame tube. The PCB along with the HV transformer may then be potted, for example, within a protective case or cover housing to electrically insulate and protect the circuit, for example, from the user, the fuels, and mechanical damage. Such material and assembly costs, however, add much to the cost of such systems.

The custom built high voltage transformer, for example, is one particularly expensive component that adds considerable cost to the igniter. Several reasons for this high cost is that the high voltage transformer is often a switching transformer that requires a custom molded bobbin and one or more core pieces, multiple custom wound coils, several high voltage insulator components, hand soldering, and meticulous hand assembly to accommodate the particular demands associated with fabricating a high voltage switching power supply.

For example, some of these assembly cost considerations involve attention to isolation spacing and/or insulation thickness to accommodate high voltage breakdown issues. In addition, to accommodate switching issues, component or wire placement and layout may become important, particularly when higher switching frequencies are utilized. Another assembly cost is the amount of potting material which is used to encase the PCB and HV transformer of the igniter, and the time required for such potting operations, which may need to be done in a partial vacuum to avoid bubbles that lower the breakdown voltage in the respective area. Thus, the overall size of the components of the igniter becomes a cost issue, since more potting material and time may be required to complete the potting operation in a difficult manufacturing environment.

Heating applications likely produce the greatest potential for component failures, where the igniter and the electronic control module may be particularly susceptible to extremes of thermal degradation and chemical changes due to exposure to fuels. Therefore, the enclosures, potting material used, and mounting locations of such assemblies represent important issues for the reliability and safety of a fuel-based burner.

Accordingly, for reliability, cost, and simplicity of assembly reasons, there is a need for an improved igniter for a fuel-based burner that uses smaller and more cost effective components.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The present invention is directed to an improved igniter and an igniter bobbin for a high voltage burner igniter that reduces parts count and simplifies assembly of the igniter used in fuel based burners for boilers, forced air furnaces and water heaters, for example. The igniter bobbin of the present invention comprises two high voltage insulators and a coil bobbin of a high voltage transformer molded or otherwise integrated together into a single monolithic structure. For example, the igniter bobbin of the present invention may be molded from an insulative material to form the single monolithic structure that insulates the high voltage electrodes, which are inserted within the high voltage insulators portion of the structure, and that insulates the primary and secondary coils that are wound onto the coil bobbin portion of the molded structure. Thus only one igniter bobbin part is needed to replace the separate HV insulators, coil bobbin, and other attachment means parts used in a prior art.

The igniter bobbin insulative material that is used may include polyethylene terephthalate (PET), urethane, epoxy, fiberglass, glass reinforced or modified polyethylene terephthalate, thermoplastic, thermoset plastic, ferrite, glass, and ceramic, for example, or any combination thereof. However, many other materials may be molded or otherwise formed into the monolithic igniter bobbin structure.

In an aspect of the present invention, the HV insulators and the coil bobbin structures are integrated together into a single part or structure identified as the igniter bobbin, wherein the separate purchase and assembly costs of these parts may be saved in the completed HV transformer of the igniter.

The igniter of the present invention comprises, in one embodiment, a high voltage switching power supply comprising a switching circuit including a number of electronic components mounted on a printed circuit board (PCB), a high voltage (HV) switching transformer that may be custom built for the particular switching frequency chosen for the application, power supply leads for connection to the input power supply, HV electrodes attached to the switching circuit PCB, and a case or enclosure into which the igniter components are potted.

In one aspect of the invention, the HV transformer of the igniter may be a switching transformer comprising the insulative igniter bobbin, a high permeability core, a primary coil, a HV secondary coil, and one or more low voltage (LV) coils wound onto a coil bobbin portion of the igniter bobbin, wherein the LV coils are used for feedback to the switching circuit.

In one embodiment of the invention, the HV secondary coil is connected to a pair of high voltage electrodes which are held within high voltage insulator portions of the igniter bobbin.

In another aspect, the primary and secondary coils are wound around a coil bobbin portion of the igniter bobbin.

In still another aspect, the primary and secondary coils of wire comprise magnet wire.

In yet another aspect, the high-permeability core is a segmented core comprising two substantially identical molded ferrite cores having one of an "E" shape or a "U" shape, for example, wherein the cores are joined together at their open ends, and wherein one segment of the cores extend through and join within a central portion of the igniter bobbin, and one or more other segments of the core extend around the outside of the igniter bobbin forming one or more substantially closed magnetic paths. Other segmented and non-segmented core shapes and materials are also anticipated in the context of the present invention.

In one aspect of the invention, the igniter further comprises a case to enclose and protect the switching circuit components and the high voltage switching transformer of the igniter. The case may comprise an insulating material.

In another aspect, the igniter further comprises a potting material to insulate and affix the switching circuit components and the high voltage switching transformer within the case.

In still another aspect, the igniter comprises a primary supply input to provide electrical power to the igniter.

In yet another aspect, the igniter bobbin further comprises one or more projections extending from the monolithic structure operable to support, or to anchor, or both, the igniter bobbin to the printed circuit board.

In another embodiment of the present invention, a fuel based burner is disclosed. The burner comprises a flame tube, a burner motor operable to blow air and pump fuel into the flame tube as a fuel-air mix, a fuel pump coupled to the burner motor and operable to pump the fuel into the flame tube, a fan or blower coupled to the burner motor and operable to blow the air into the flame tube, and an igniter operable to provide a high voltage arc for igniting the fuel-air mix in the flame tube.

The igniter comprises a primary supply input to receive electrical power for the igniter, a switching circuit comprising one or more switching and non-switching components, and a high voltage switching transformer, comprising an igniter bobbin comprising a coil bobbin having a pair of high voltage insulators extending therefrom in a single monolithic structure. Primary and secondary coils of wire are wound onto the igniter bobbin, the secondary coils comprising a high voltage secondary coil and one or more low voltage secondary coils. A pair of high voltage electrodes are connected to the high voltage secondary coil of wire and held within the high voltage insulators of the igniter bobbin. The igniter further comprises a segmented core operably coupled to the igniter bobbin configured to provide mutual inductive coupling between the primary and secondary coils of the igniter bobbin, wherein the primary coil of the high voltage switching transformer is alternately switched between voltages supplied at the primary supply input to induce a high voltage arc between the pair of high voltage electrodes to ignite the fuel-air mix in the burner.

The burner further comprises a flame sensor for detecting the presence of a flame in the flame tube; and a primary burner controller operable to control the operation of the burner motor, and igniter in response to the flame detection in the flame tube; wherein in an ignition mode the primary burner controller turns on the burner motor to pump fuel and blow air into the flame tube, and energizes the igniter to supply a high voltage arc to ignite the fuel-air mix, then monitors the flame sensor until a flame is sensed, and thereafter in a heating mode the controller deenergizes the igniter and monitors a thermostat heat signal input until the heat signal is no longer issued by the thermostat, whereby the heating is discontinued.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages and novel features of the invention will become apparent from the following detailed description of the invention when considered in conjunction with the drawings.

DETAILED DESCRIPTION OF THE INVENTION

Figure 1:
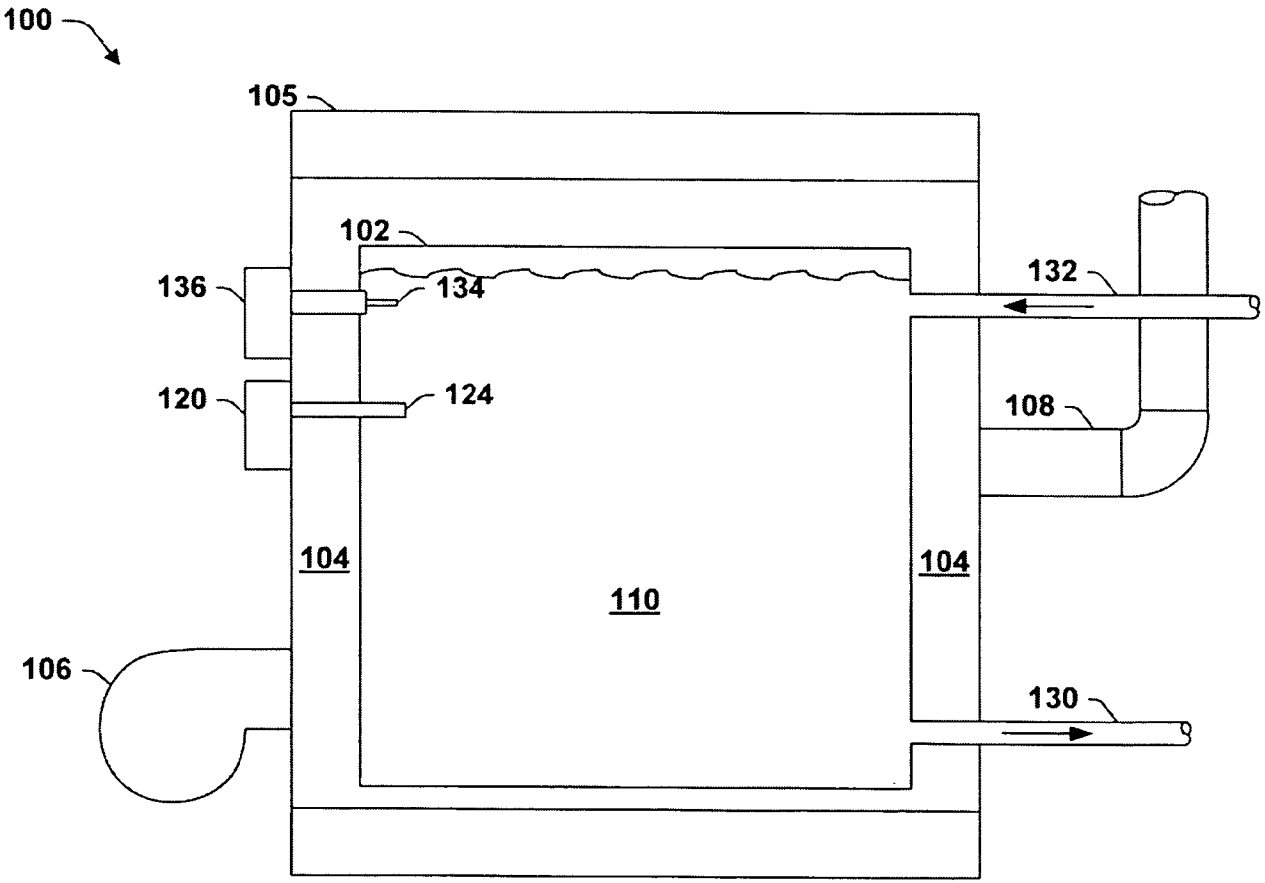
FIG. 1 (PRIOR ART)
FIG. 1 is a simplified diagram of a prior art hot water boiler system using a conventional burner for heating water in a boiler.

The present invention will now be described with reference to the attached drawings, wherein like reference numerals are used to refer to like elements throughout. The invention relates to an improved high voltage burner igniter having an igniter bobbin that reduces parts count and simplifies assembly of the igniter used in fuel-based burners for boilers, forced air furnaces and water heaters, for example. In one aspect of the invention, the igniter bobbin incorporates two high voltage insulators and a coil bobbin of a high voltage transformer molded or otherwise integrated together into a single monolithic structure. Because the igniter bobbin is a single part or single monolithic structure, the purchase and assembly costs of the several separate conventional parts may be saved in the simplified fabrication of the completed high voltage (HV) igniter.

The igniter bobbin of the present invention may be molded from one or more of a variety of insulative materials to form the single monolithic structure. The igniter bobbin insulates two high voltage electrodes that are inserted within the high voltage insulator portions of the structure, while the primary and secondary coils are wound onto the coil bobbin portion of the structure. The high voltage electrodes contact spark electrodes within the flame tube for igniting the fuel-air mix.

The HV transformer of the igniter also has a high-permeability core such as a segmented E-core comprising two substantially identical molded ferrite cores having an "E" shape and joined together at their open ends. The middle segments of the E-cores extend through and join within a central portion of the igniter bobbin, and the other two outer segments of the core extend around the outside of the igniter bobbin forming two substantially closed magnetic paths.

In order to better appreciate one or more features of the invention, several exemplary implementations of the burner, the burner igniter, and the igniter bobbin are hereinafter illustrated and described with respect to the following figures.

FIG. 1, for example, illustrates a prior art hot water boiler system 100, wherein a fuel-based (e.g., fuel oil, diesel, K1, etc.) burner, such as may be used for heating in boilers, forced air furnaces and water heaters, is used to heat the water within a boiler to a set temperature detected by a temperature sensor. A low-water cut-off detector is used to detect the presence of water in the boiler for safe operation thereof above the level of this detector. Numerous types of common temperature sensing devices or sensors are utilized in such heating systems to help regulate the temperature and level of water within the boiler.

The conventional boiler 100 of FIG. 1, comprises a boiler tank 102 surrounded by an insulating material layer 104 within a boiler enclosure 105. A burner 106 ignites and burns the fuel-air mix in a flame tube and is directed thru a flue vent 108, to heat the water 110 within the tank 102 to a temperature set by a temperature sensor 120. The temperature sensor 120 has, for example, a fluid filled copper bulb 124, which expands when heated to actuate a high/low limit module for control of the system about a temperature set point. The heated water 110 is circulated through a feed water line 130 to an external heat exchanger (not shown) and the cooled water returns to the boiler through a supply/return line 132. If the level of the water 110 within the boiler tank 102 drops below the level of a live probe 134 of a low-water cut-off device 136, the burner 106 is shut-down until more water 110 is added to the boiler 100 to maintain safe operation by avoiding boiler damage.

Figure 2A:
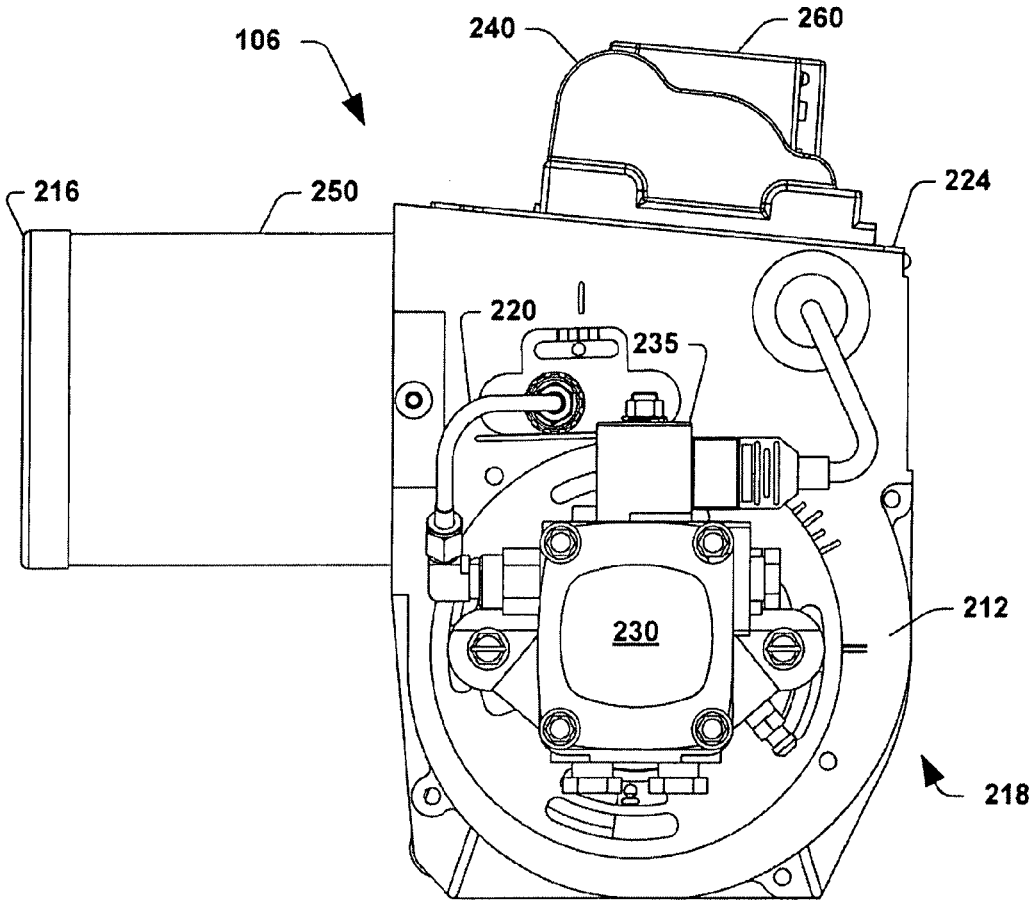
FIG. 2A (PRIOR ART)
FIGS. 2A and 2B are two views of a conventional fuel oil burner comprising a conventional electronic oil igniter, and a conventional primary burner controller, respectively, such as may be used for heating in boilers, forced air furnaces and water heaters, including in the prior art boiler system of FIG. 1.
Figure 2B:
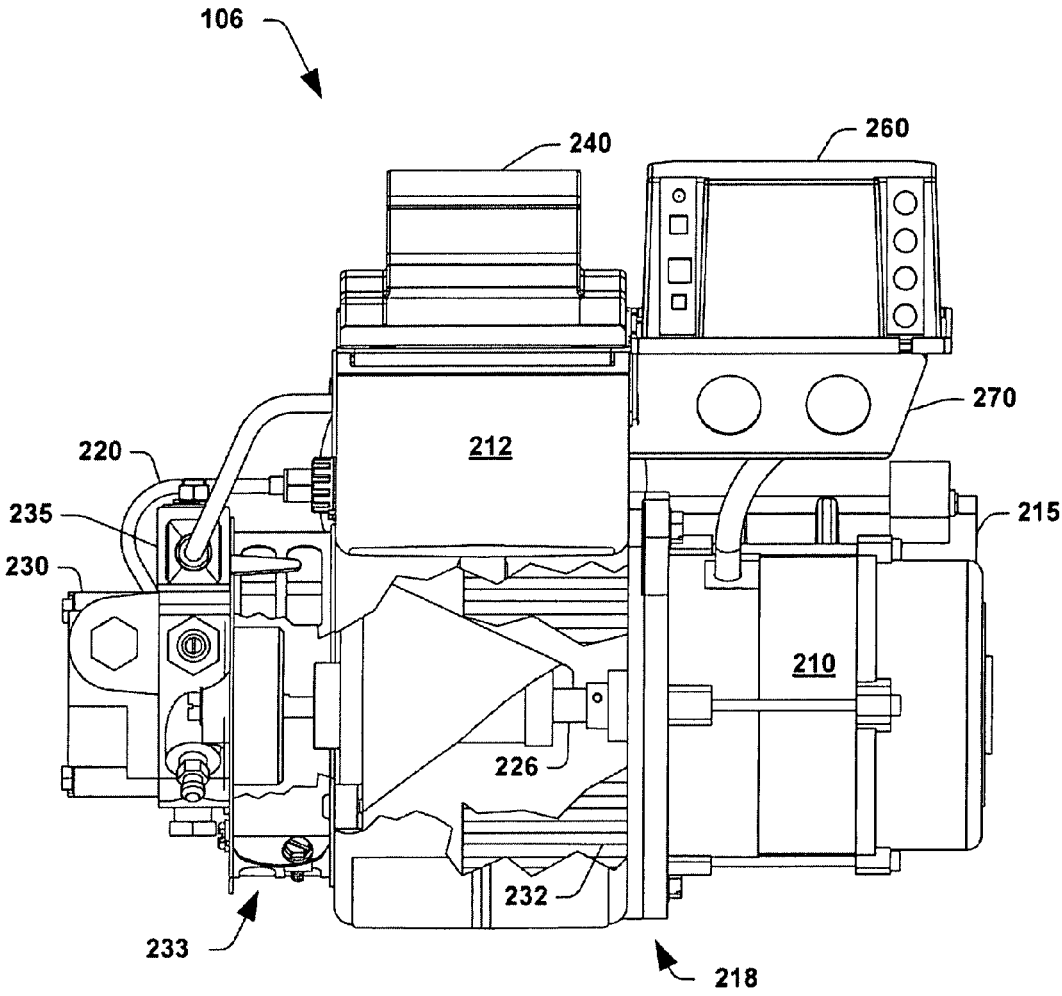
FIG. 2B (PRIOR ART)
Figure 3:
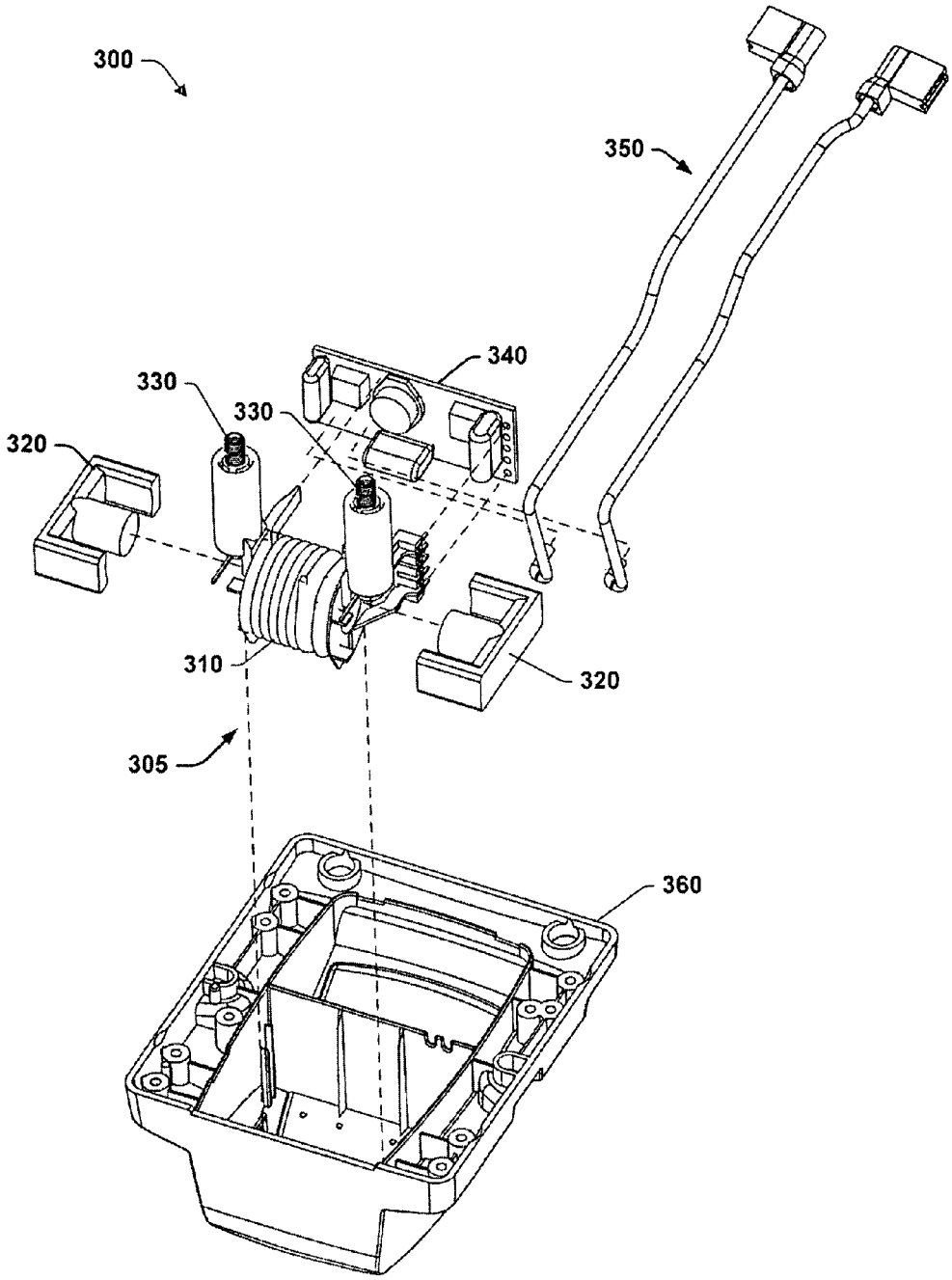
FIG. 3 illustrates an exploded view of the components of an exemplary improved igniter used in accordance with an aspect of the present invention for igniting a fuel-air mix within a fuel-based burner and in place of the prior art igniter, such as that of FIGS. 2A and 2B, the improved igniter comprising an igniter bobbin such as may be used in a high voltage transformer.

FIGS. 2A and 2B illustrate further details of a conventional fuel oil burner 106 such as may be used for heating in boilers, forced air furnaces and water heaters, including in the prior art boiler system 100 of FIG. 1. The burner illustrated is a fuel oil burner such as may be used in domestic burner applications.

Burner 106 comprises a burner motor 210 operable to start, assisted by starting capacitor 215, the motor 210 coupled by drive shaft 226 to a blower wheel 232 within a blower housing 212 of a blower 218 to blow air, supplied by air inlet portion 233 in the blower housing 212. The motor 210, is also used to pump fuel, coupled to a fuel pump 230, and controlled by a fuel valve 235 (e.g., a solenoid valve), into an air tube or a flame tube 250 as a fuel-air mix. Thus, the fuel pump 230 and blower 218 are both coupled by the drive shaft 226 to the burner motor 210 to pump the fuel and blow the fuel-air mix into the flame tube 250, while an igniter 240 provides a high voltage arc for igniting the fuel-air mix in the flame tube 250.

The air/flame tube 250 also contains a combustion head (not shown) situated or positioned at one end 216 of the flame tube 250 opposite the housing 212, the end 216 having a nozzle and electrode assembly (not shown) positioned thereat. The nozzle is coupled to the fuel pump 230 by a fuel line 220 for delivery of fuel oil to the burner. The electrode assembly in the flame tube 250 is coupled to a transformer or other type ignition device such as igniter 240 residing on a top portion 224 of the blower housing 212.

The burner 106 further comprises an internal flame sensor (not shown) for detecting the presence of a flame in the flame tube 250. An electronic control or primary burner controller 260 and the igniter 240 are wired into a junction box 270 for electrical connection to the components of the burner 106. The primary burner controller 260 is operable to control the operation of the burner motor 210, and igniter 240 to initiate delivery of oil, air and spark to the ignition head at 216 in response to the flame sensor and an external temperature detection of a thermostat (not shown) thermally associated with the heating system or boiler, for example.

The controller 260 may also operate to re-initiate ignition if combustion is discontinued unexpectedly and may further discontinue delivery of oil to the nozzle if ignition cannot be re-established within a predetermined lock-out time period (sometimes referred to as a safety lock-out condition).

Various types of controllers exist for oil burners. The controller 260 illustrated in prior art FIGS. 2A and 2B represent one basic type of controller that is used extensively. The controller 260 initiates air flow and fuel delivery concurrently via the motor drive shaft, while concurrently initiating a spark at the head via a signal to the igniter 240.

FIGS. 3, and 4A-4C illustrate the components of an exemplary improved igniter 300 used in accordance with an aspect of the present invention for igniting a fuel-air mix within a fuel-based burner, similar to the burner 106 of FIGS. 1, 2A, and 2B. The improved igniter 300 forms a high voltage (HV) switching power supply comprising an igniter bobbin 310 such as may be used in a high voltage transformer 305. The high voltage transformer 305 comprises the igniter bobbin 310 having primary and secondary coils of wire wound thereon, a two-piece ferrite E-core 320 that electro-magnetically couples the coils of the transformer 305, and a pair of HV electrodes 330 connected to the secondary coil of the transformer 305. The HV electrodes 330 are inserted within HV insulators 310*b*, which are integrally formed together with, and from the same material as the igniter bobbin 310. The middle leg of each of the ferrite E-core pieces 320 extend thru and join within a central opening in the igniter bobbin 310, while the outer legs of the E-core pieces 320 join around the outside, to surround the coils of the igniter bobbin 310.

Figure 4A:
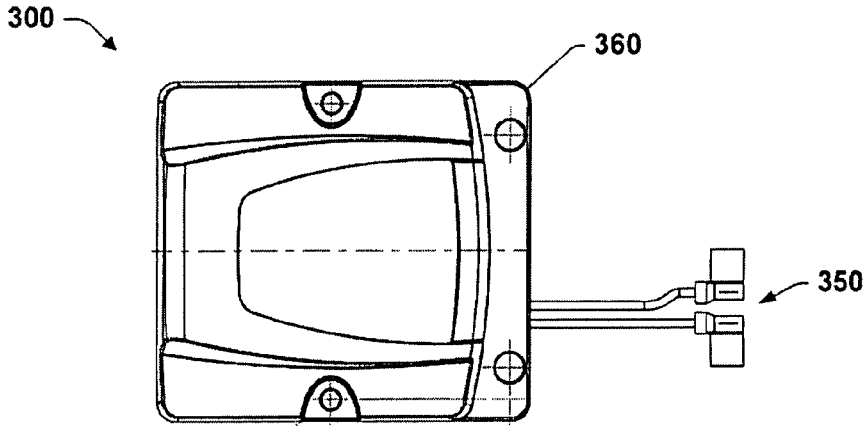
FIGS. 4A-4C illustrate top, bottom, and cross-sectional side views of the exemplary improved igniter of FIG. 3, used in accordance with an aspect of the present invention for igniting a fuel-air mix within a fuel-based burner and in place of the prior art igniter of FIGS. 2A and 2B, the improved igniter having an igniter bobbin such as may be used in the high voltage transformer of FIG. 3.
Figure 4B:
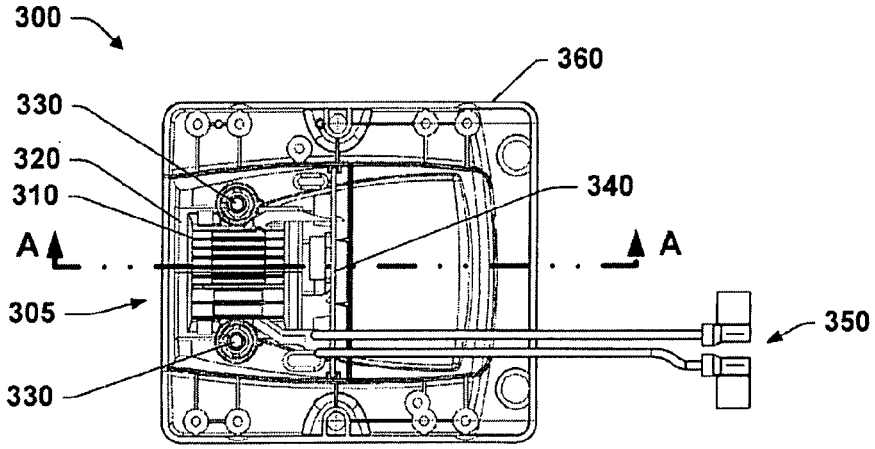
Figure 4C:
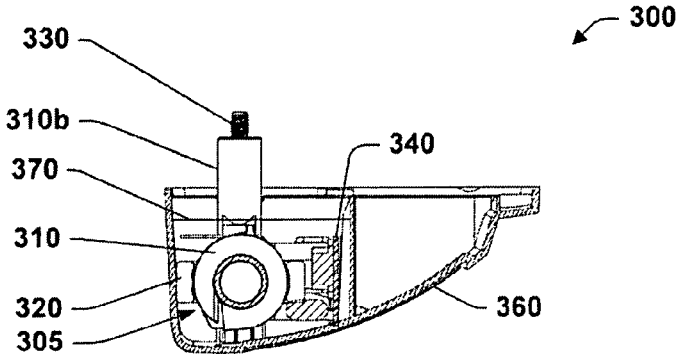

The example igniter 300 further comprises a switching circuit 340 comprising a printed circuit board (PCB) having various electronic components mounted thereto. The switching circuit 340 receives power (e.g., 120 VAC, or 12 VDC) via supply leads 350, and alternately switches the power to the primary coil of the high voltage transformer 305 to provide the high voltage at the secondary coils and HV electrodes 330 attached to the electrode assembly in the flame tube (e.g., flame tube 250) for ignition of the fuel within the burner (e.g., burner 106). Finally, the igniter assembly further comprises a case 360 to house and protect the aforementioned components, which are further protected and held in place with a potting material 370 (e.g., epoxy, urethane, silicone rubber). For example, FIG. 4C illustrates a cross-sectional view A-A of the igniter 300 of FIG. 4B, illustrating the potting material 370 filled to an exemplary level within the igniter case 360.

Although a two-piece ferrite E-core 320 is described in association with the igniter of the present invention, the use of two or more such segments of the E-core may be used within the HV transformer, as well as the use of another such high permeability material, or another such shape core such as a "U" shaped core, for example, is anticipated in accordance with the present invention.

Figure 5:
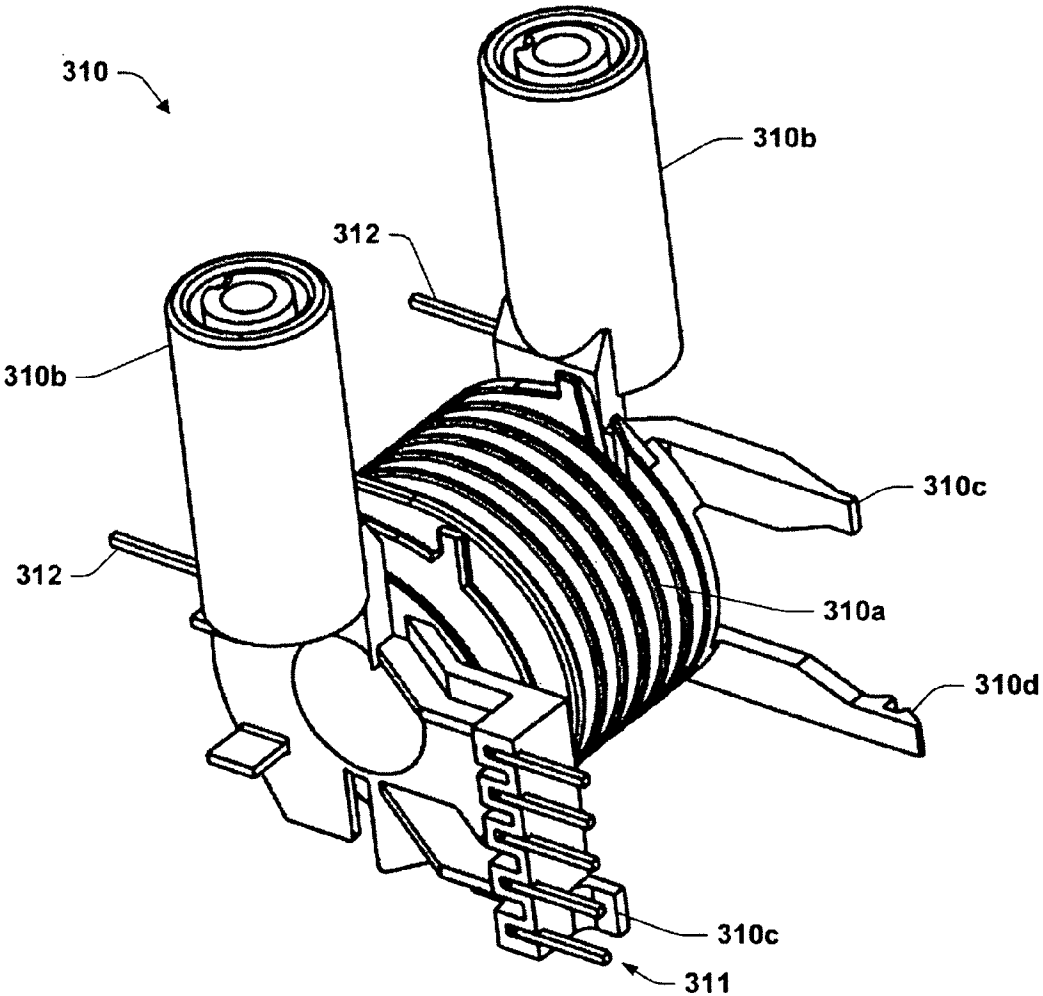
FIG. 5 is a perspective view of the exemplary igniter bobbin of FIGS. 3, 4A, 4C, and 4D, comprising both a coil bobbin and two high voltage insulators formed together within a single monolithic structure, such as may be used in the high voltage transformer of the igniter of FIG. 3 in accordance with the present invention.

FIG. 5 illustrates the exemplary igniter bobbin 310 of the igniter of FIGS. 3, 4A, 4C, and 4D, in accordance with one embodiment of the present invention. The exemplary igniter bobbin 310 comprises both a coil bobbin 310*a* and two high voltage insulators 310*b* formed together within a single monolithic structure 310, such as may be used in the high voltage transformer 305 of the igniter 300 of FIG. 3 in accordance with the present invention. The igniter bobbin 310 may be formed by molding a plastic or another insulator into the shape shown in FIG. 5. For example, the insulative material of the igniter bobbin 310 may comprise polyethylene terephthalate (PET), urethane, epoxy, fiberglass, glass reinforced or modified polyethylene terephthalate, thermoplastic, thermoset plastic, ferrite, glass, ceramic, or any combination thereof.

The exemplary igniter bobbin 310 also has printed circuit board (PCB) standoff's 310*c* to hold the bobbin a fixed distance from the PCB 340, and a PCB anchor 310*d* used to support and anchor the bobbin 310 to the PCB 340. The exemplary igniter bobbin 310 further comprises low voltage terminal inserts 311 and high voltage HV terminal inserts 312, which are inserted into the bobbin 310, for example, before or during the molding of the bobbin 310. The low voltage terminal inserts 311 and high voltage HV terminal inserts 312 are later connected to low voltage primary and HV secondary coils of wire, respectively, wound onto the coil bobbin portion 310*a* of the igniter bobbin 310. The ferrite E-core 320 is then assembled in and surrounding the igniter bobbin 310, and the HV electrodes 330 are inserted into the HV insulators 310*b*, and contacting the HV terminal inserts 312 connected to the HV secondary coil.

Accordingly, the improved igniter bobbin 310 of the present invention enables a smaller HV transformer 305 design by using a smaller coil bobbin layout and greater mutual coupling provided by the use of the segmented E-core 320. In addition, the smaller transformer 305 and PCB 340 design permits lower fabrication and materials costs including the use of less potting material to incase the components of the igniter 300. Further, in another aspect of the invention, because the coil bobbin 310*a* and the HV insulators 310*b* are formed from the same insulative material and monolithically integrated into the igniter bobbin 310, the purchase and assembly costs of these otherwise separate components as well as the attachment of the same is therefore avoided. In yet another aspect of the present invention, the PCB anchor 310*d* and the PCB standoffs 310*c* further reduce costs associated with assembly and attachment of the igniter bobbin 310 to the PCB 340.

Figure 6:
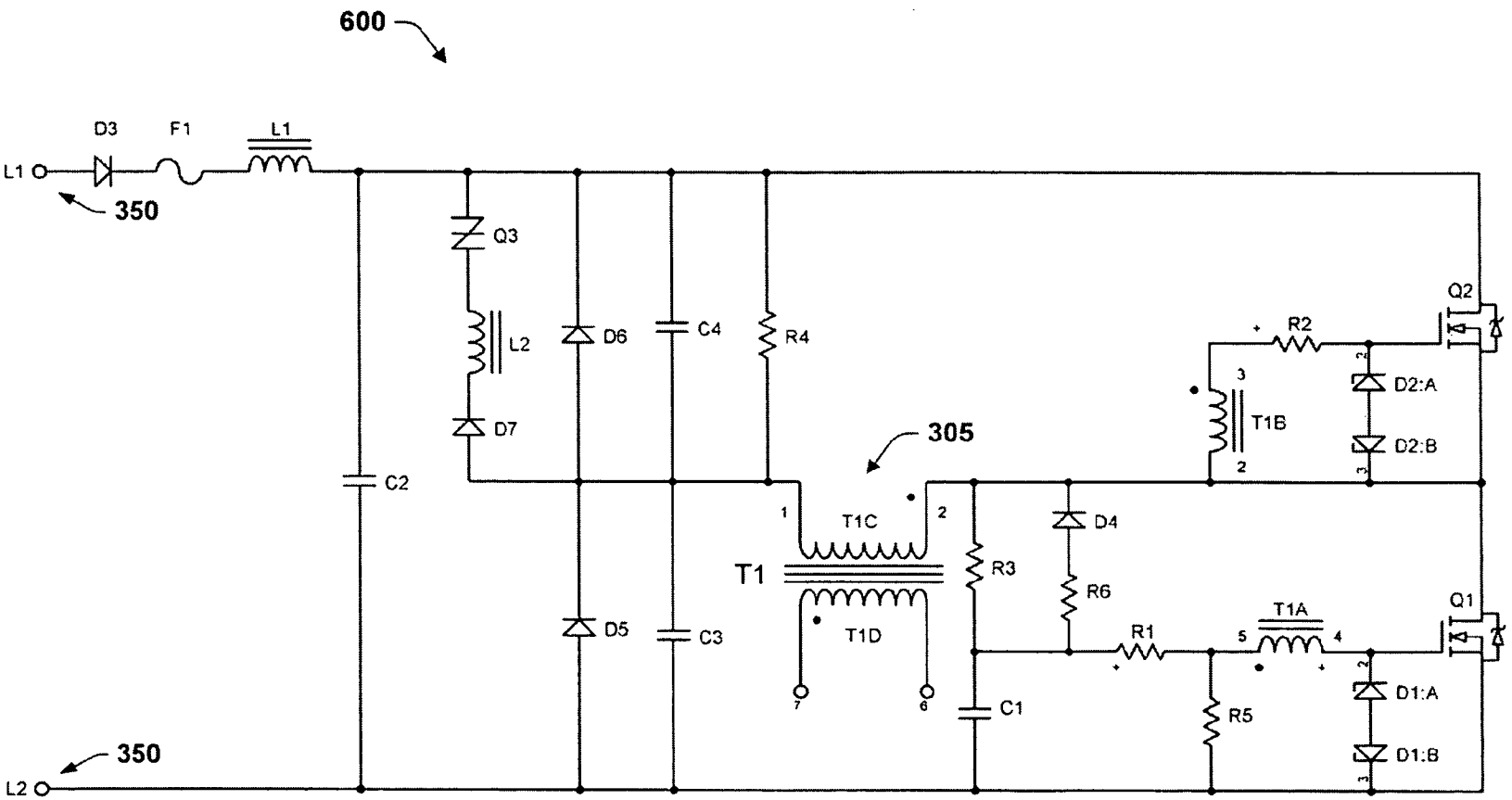
FIG. 6 is a schematic diagram of an exemplary improved igniter such as the igniter of FIGS. 3, 4A, 4C, and 4D, in accordance with one implementation of the present invention.

FIG. 6 illustrates a schematic diagram of an exemplary igniter circuit 600 of the improved igniter 300 of FIGS. 3, 4A, 4C, and 4D, in accordance with one implementation of the present invention. The igniter circuit 600 comprises, for example, the components of printed circuit board 340, the HV transformer (e.g., T1) 305, and the supply voltage leads (e.g., L1, and L2) 350 of igniter 300. Igniter circuit 600 substantially comprises a high voltage DC switching power supply. For example, an AC supply voltage at L1 and L2 is rectified to a DC voltage by D3, fuse protected by F1 and filtered by inductor L1 and filter capacitor C2 to smooth the DC supply voltage for use by the HV switching circuit 600.

Coil T1C of HV transformer T1 305 is the lower voltage primary coil (e.g., at terminals 1 and 2) which is driven by drive transistors Q1 and Q2 to provide alternating polarities of the supply voltage (AC), at a frequency determined by the time constants of the switching circuit 600. Transformer T1305 boosts the primary AC voltage to a level suitable for producing an arc for ignition of the fuel, by way of the HV secondary coil T1D (e.g., at terminals 6 and 7) connected to the burner electrodes. Coils T1A and T1B of transformer T1 305 provide low voltage gate drive feedback to driver transistors Q1 and Q2 to maintain the switching oscillations, Beneficially, the improved coil bobbin 310 used in transformer T1 305 of igniter 300 permits the fabrication of a smaller transformer, in part, provided by a smaller coil bobbin and greater mutual coupling enabled by the use of the segmented E-core 320.

Figure 7:
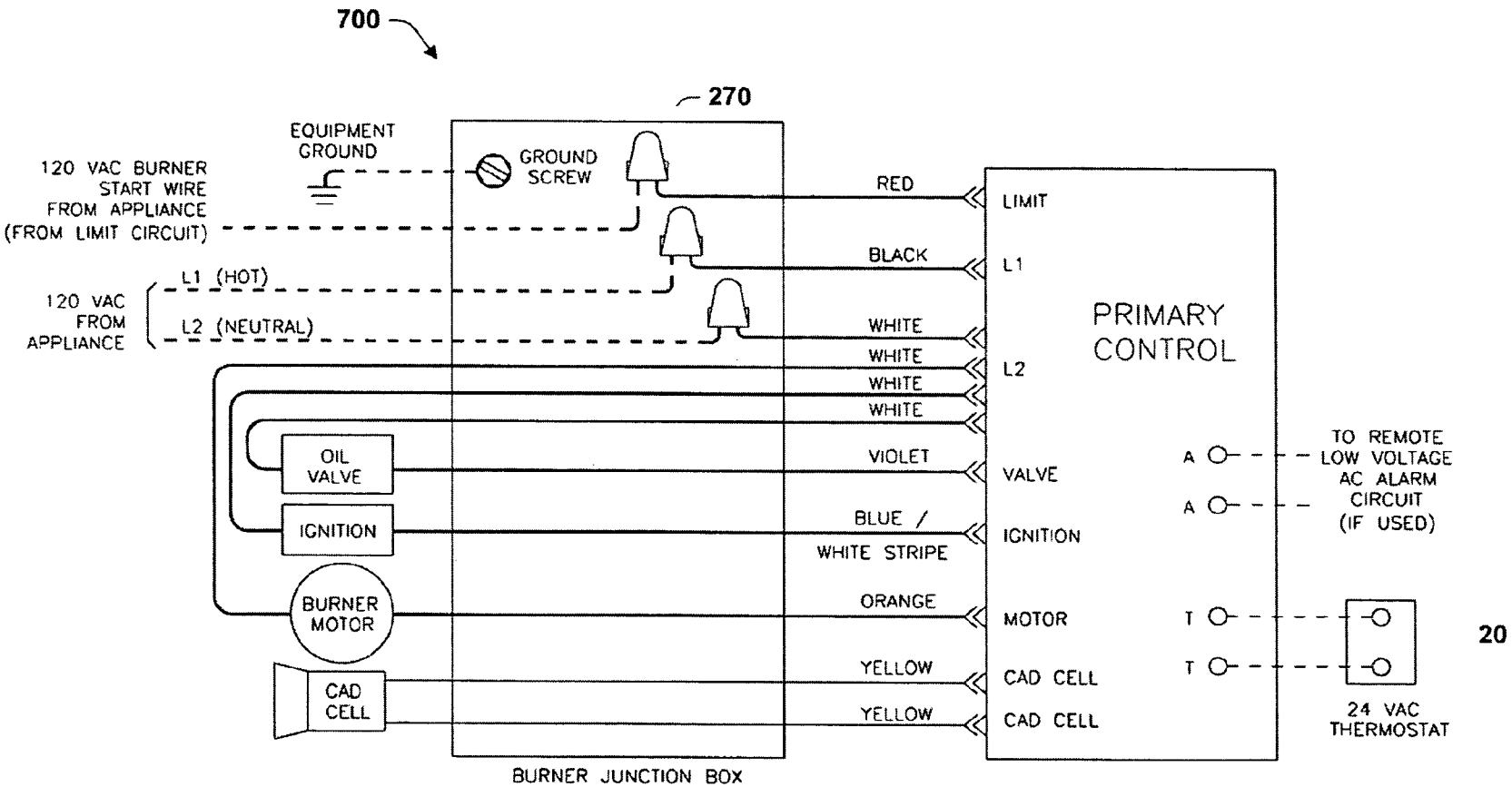
FIGS. 7 and 8 are wiring diagrams of typical burner systems such as may use the improved igniter of FIGS. 3, 4A, 4C, and 4D, in accordance with one implementation of the present invention.
Figure 8:
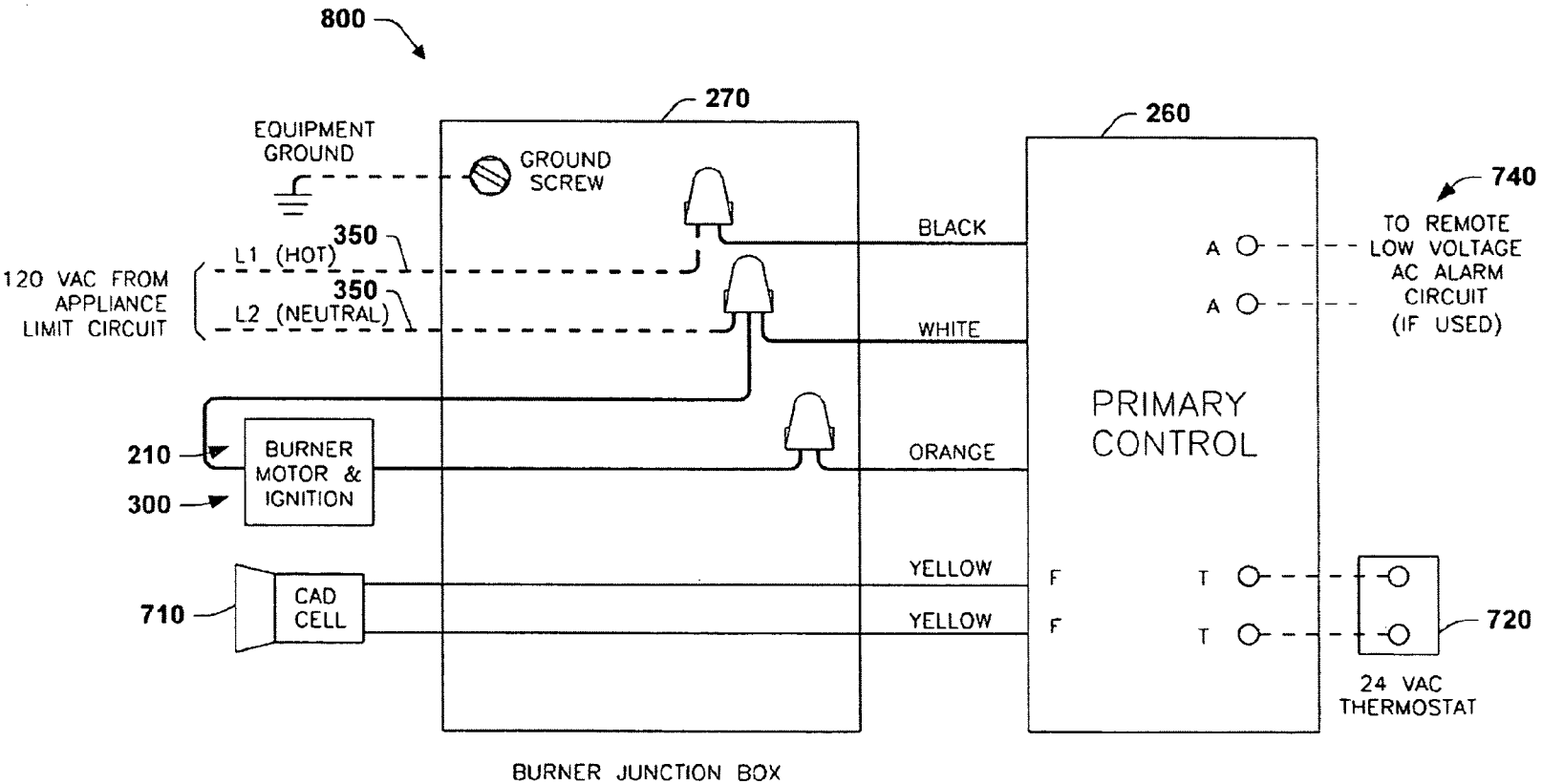

FIGS. 7 and 8 illustrate wiring diagrams of typical burner systems 700 and 800, respectively, such as may use the improved igniter 300 of FIGS. 3, 4A, 4C, and 4D, in accordance with one or more implementations of the present invention. The burner systems illustrated and discussed herein represent several examples of the various other applications that may use the ignition controller and/or the improved coil bobbin and all such applications are contemplated in the context of the present invention.

Burner system 700 of FIG. 7, for example, comprises an oil valve 235 to permit purging of the fuel oil line (e.g., 20 of FIG. 2A), the igniter 300, the burner motor 210, a cadmium sulfide (CAD) cell 710 which detects the presence of a flame, and an input supply via supply leads 350, all interconnected through a junction box 270. Burner system 700 further comprises a primary burner controller 260 (e.g., an R7184 Series primary control) wired into the junction box 270 that controls the burner system 700 in response to the temperature detected at a thermostat 720, and/or optionally by a burner start wire 730 from the appliance wherein the burner resides. Additionally, the burner system 700 of FIG. 7 may have a remote low voltage AC alarm circuit output 740 to output an alarm signal, for example, to indicate an over-temperature, a lock-out, an impending freeze, or another such system error condition. The operation of such burner systems is well known in the industry and as such need not be described for the sake of brevity, but is only presented herein to illustrate the context for the improved burner igniter 300 and the improved igniter bobbin 310 used in accordance with the present invention.

Burner system 800 of FIG. 8, for example, is typical of a non-purging primary control system, and as such lacks the oil valve 235 and/or the optional burner start wire 730 of the otherwise similar burner system 700 of FIG. 7.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising."

What is claimed is:

1. An igniter for a fuel based burner, operable to provide a high voltage arc for igniting a fuel-air mix in the burner, the igniter comprising: a primary supply input to receive electrical power for the igniter; a switching circuit comprising one or more switching components; and a high voltage switching transformer, comprising: an igniter bobbin comprising a coil bobbin and a pair of high voltage insulators extending therefrom made of the same material to form one piece, resulting in a single monolithic structure; primary and secondary coils of wire wound onto the igniter bobbin, the coils comprising one or more low voltage primary coils of wire and a high voltage secondary coil of wire; and wherein the primary coil of the high voltage switching transformer is alternately switched between voltages received at the primary supply input to induce a high voltage at the secondary coil and produce an arc for igniting the fuel-air mix in the burner.

2. The igniter of claim 1, wherein the high voltage switching transformer further comprises:

a pair of high voltage electrodes connected to the high voltage secondary coil of wire and situated within the high voltage insulators of the igniter bobbin;

wherein the primary coil of the high voltage switching transformer is alternately switched between voltages received at the primary supply input to induce a high voltage at the secondary coil and produce an arc between the pair of high voltage electrodes for igniting the fuel-air mix in the burner.

3. The igniter of claim 1, wherein the high voltage switching transformer further comprises:

a pair of high voltage electrodes connected to the high voltage secondary coil of wire and situated within the high voltage insulators of the igniter bobbin; and a high-permeability core operably coupled to the igniter bobbin to provide mutual inductive coupling between the primary and secondary coils wound on the igniter bobbin;

wherein the primary coil of the high voltage switching transformer is alternately switched between voltages received at the primary supply input to induce a high voltage at the secondary coil and produce an arc between the pair of high voltage electrodes for igniting the fuel-air mix in the burner.

4. The igniter of claim 1, wherein the insulator material comprises at least one of polyethylene terephthalate (PET), urethane, epoxy, fiberglass, glass reinforced or modified polyethylene terephthalate, thermoplastic, thermoset plastic, ferrite, glass, ceramic, and an insulator.

5. The igniter of claim 1, further comprising a printed circuit board for mounting the switching components of the switching circuit.

6. The igniter of claim 5, wherein the igniter bobbin further comprises one or more projections extending therefrom and operable to support, or to anchor, or both, the igniter bobbin to the printed circuit board.

7. The igniter of claim 5, wherein the igniter bobbin further comprises two or more conductive terminals molded into the monolithic structure for connecting the primary and secondary coils of wire to the printed circuit board.

8. The igniter of claim 1, wherein the high-permeability core is a segmented core comprising two substantially identical molded ferrite cores having one of an E shape and a U shape, wherein the cores are joined together at their open ends, and wherein one segment of the cores extend through and join within a central portion of the igniter bobbin, and one or more other segments of the core extend around the outside of the igniter bobbin forming one or more substantially closed magnetic paths.

9. The igniter of claim 1, wherein the pair of high voltage electrodes connected to the high voltage secondary coil of wire and situated within the high voltage insulators of the igniter bobbin comprise threaded bolts.

10. The igniter of claim 1, further comprising a case to enclose and protect the switching circuit components and the high voltage switching transformer of the igniter, the case formed from an insulating material.

11. The igniter of claim 10, further comprising a potting material to insulate and substantially incase the switching circuit components and the high voltage switching transformer within the case.

12. An igniter operable to provide a high voltage arc for igniting a fuel-air mix in the burner, the igniter comprising: a primary supply input to receive electrical power for the igniter; a switching circuit comprising one or more switching components; and a high voltage switching transformer, comprising: an igniter bobbin comprising a coil bobbin and a pair of high voltage insulators extending therefrom made of the same material to form one piece, resulting in a single monolithic structure; primary and secondary coils of wire wound onto the igniter bobbin, the coils comprising a high voltage secondary coil of wire and one or more low voltage secondary coils of wire; a pair of high voltage electrodes connected to the high voltage secondary coil of wire and held within the high voltage insulators of the igniter bobbin; and a segmented core operably coupled to the igniter bobbin configured to provide mutual inductive coupling between the primary and secondary coils of the igniter bobbin; wherein the primary coil of the high voltage switching transformer is alternately switched between voltages received at the primary supply input to induce a high voltage at the secondary coil and produce an arc between the pair of high voltage electrodes for igniting the fuel-air mix in the burner.

13. The igniter of claim 12, further comprising:

a flame tube;

a burner motor operable to blow air and pump fuel into the flame tube as a fuel-air mix;

a fuel pump coupled to the burner motor and operable to pump the fuel into the flame tube;

a blower coupled to the burner motor and operable to blow the air into the flame tube.

14. The igniter of claim 13, further comprising:

a flame sensor for detecting the presence of a flame in the flame tube; and a primary burner controller operable to control the operation of the burner motor, and igniter in response to the flame detection in the flame tube;

wherein in an ignition mode the primary burner controller turns on the burner motor to pump fuel and blow air into the flame tube, and energizes the igniter to supply a high voltage arc to ignite the fuel-air mix, then monitors the flame sensor until a flame is sensed, and thereafter in a heating mode the controller deenergizes the igniter and monitors a thermostat heat signal input until the heat signal is no longer issued by the thermostat, whereby the heating is discontinued.

15. The igniter of claim 14, further comprising a fuel valve for turning on or off fuel to the burner.

16. The igniter of claim 12, wherein the insulator material comprises at least one of polyethylene terephthalate (PET), urethane, epoxy, fiberglass, glass reinforced or modified polyethylene terephthalate, thermoplastic, thermoset plastic, ferrite, glass, ceramic, and an insulator.

17. The igniter of claim 12, further comprising a printed circuit board for mounting the components of the switching circuit.

18. The igniter of claim 17, wherein the igniter bobbin further comprises one or more projections extending from the monolithic structure operable to support, or to anchor, or both, the igniter bobbin to the printed circuit board.

19. The igniter of claim 17, wherein the igniter bobbin further comprises two or more conductive terminals molded into the monolithic structure for connecting the primary and secondary coils of wire to the printed circuit board.

20. The igniter of claim 12, wherein the segmented core comprises two substantially identical molded ferrite cores, wherein the cores join together at their open ends, and wherein one segment of the cores extend through and join near the center of the igniter bobbin, and one or more other outer segments of the core extend around the outside of the igniter bobbin forming one or more substantially closed magnetic paths.

21. The igniter of claim 12, wherein the pair of high voltage electrodes connected to the high voltage secondary coil of wire and held within the high voltage insulators of the igniter bobbin comprise threaded bolts.

22. The igniter of claim 12, further comprising a case to enclose and protect the switching circuit components and the high voltage switching transformer of the igniter, the case formed from an insulating material.

23. The igniter of claim 22, further comprising a potting material to insulate and to substantially affix the switching circuit components and the high voltage switching transformer within the case.

24. The igniter of claim 12, wherein the fuel based burner comprises a burner for one of a boiler, a forced air furnace, and a water heater.

25. An igniter for a fuel based burner, operable to provide a high voltage arc for igniting a fuel-air mix in the burner, the igniter comprising: a primary supply input to receive electrical power for the igniter; a switching circuit comprising one or more switching components; and a high voltage switching transformer, comprising: an igniter bobbin comprising a coil bobbin and a pair of high voltage insulators extending therefrom and made of the same material to form one piece, resulting in a single monolithic structure; primary and secondary coils of wire wound onto the igniter bobbin, the coils comprising one or more low voltage primary coils of wire and a high voltage secondary coil of wire; a pair of high voltage electrodes connected to the high voltage secondary coil of wire and situated within the high voltage insulators of the igniter bobbin; and a high-permeability core operably coupled to the igniter bobbin to provide mutual inductive coupling between the primary and secondary coils wound on the igniter bobbin; wherein the primary coil of the high voltage switching transformer is alternately switched between voltages received at the primary supply input to induce a high voltage at the secondary coil and produce an arc between the pair of high voltage electrodes for igniting the fuel-air mix in the burner.

26. The igniter of claim 25, wherein the high-permeability core comprises two substantially identical core segments configured to join within a central portion of the igniter bobbin and to join around the outside of the igniter bobbin forming one or more substantially closed magnetic paths.

* * * * *